United States Patent [19]

Basil, Jr. et al.

[11] Patent Number: 4,757,292

[45] Date of Patent: Jul. 12, 1988

[54] MICROWAVE WINDOW

[75] Inventors: Richard V. Basil, Jr., Chatsworth; Meredith K. Eick, Torrance; Juri G. Leetmaa, Los Angeles, all of Calif.; Donald G. Swartz, Couer d'Alene, Id.

[73] Assignee: Hughes Aircraft Company, Los Angeles, Calif.

[21] Appl. No.: 894,538

[22] Filed: Aug. 8, 1986

[51] Int. Cl.[4] ..... H01P 1/08

[52] U.S. Cl. ..... 333/244; 228/124; 333/252

[58] Field of Search ..... 333/252, 99 MP, 244, 333/245; 228/122, 124

[56] References Cited

U.S. PATENT DOCUMENTS

| | | | |
|---|---|---|---|
| 2,706,275 | 4/1955 | Clark, Jr. | 333/252 X |
| 3,330,707 | 7/1967 | Reed | 333/99 MP X |
| 4,231,003 | 10/1980 | Ishimaru | 333/244 X |
| 4,602,731 | 7/1986 | Dockus | 228/124 X |

FOREIGN PATENT DOCUMENTS

| | | | |
|---|---|---|---|
| 2478869 | 9/1981 | France | 333/252 |

*Primary Examiner*—Paul Gensler

*Attorney, Agent, or Firm*—S. M. Mitchell; M. J. Meltzer; A. W. Karambelas

[57] ABSTRACT

A low noise coaxial microwave window of particular utility in hermetic and high power applications, having a metallic center conductor, a metallic outer support, and a ceramic support brazed between the two conductors. The brazed joints are specially prepared to have a series of layers and sublayers extending from the ceramic to the metal, as follows: ceramic, cermet, cermet-nickel alloy, copper-nickel alloy, copper, braze metal, and metallic piece. The nickel content of the cermet-nickel and copper-nickel alloys is limited so that the alloys are non-magnetic. The nickel-containing alloys assist in bonding the copper layer to the cermet in a reliable, reproducible fashion, but control of the nickel content avoids microwave intermodulation effects. Where the window separates a vacuum from another medium, the surface of the support contacting the vacuum is formed from at least two noncoplanar segments to eliminate the possibility of multipacting. The same techniques are used in waveguide microwave windows.

12 Claims, 1 Drawing Sheet

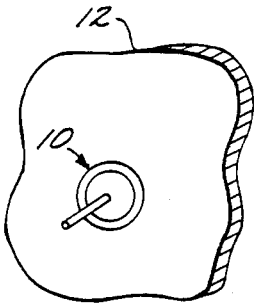
FIG. 1
FIG. 2
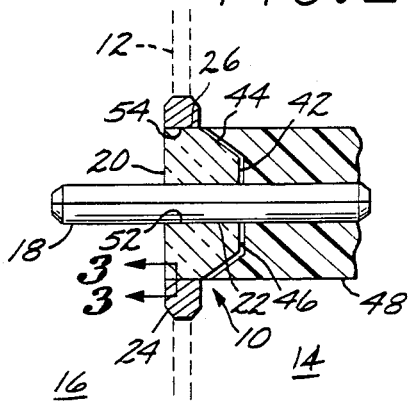
FIG. 3
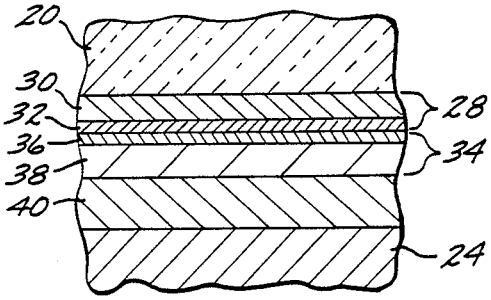
FIG. 4
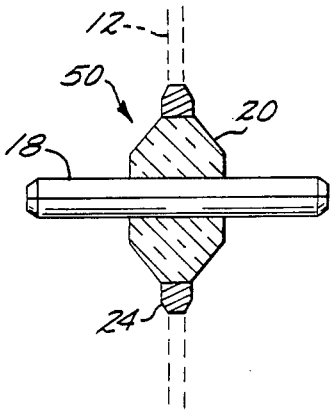
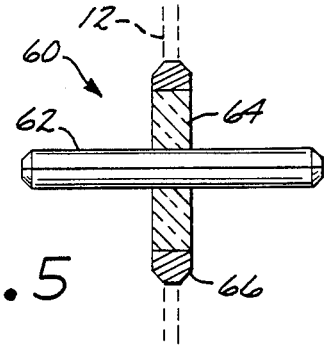
FIG. 5
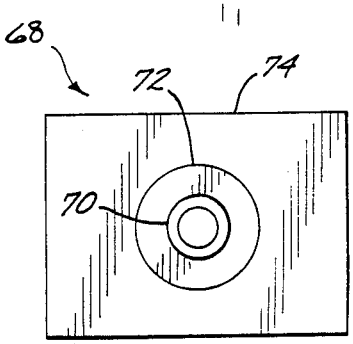
FIG. 6

MICROWAVE WINDOW

BACKGROUND OF THE INVENTION

The present invention relates to the transmission of microwave signals, and, more particularly, to a low noise microwave window used to transmit a microwave signal across a wall between two media.

Energy and information are often transmitted on microwave signals, both on earth and in space. In one application, signals transmitted to and from satellites in orbit are transmitted as microwaves. The use of microwaves is particularly desirable, since the microwaves can be readily modulated to carry large amounts of information at high power levels, and in addition are not blocked by cloud covers.

In many spacecraft transmitter applications, the microwave power levels are of such a magnitude that the associated voltages result in multipacting or breakdown when the units are operated in vacuum. The transmitters are therefore usually pressurized with an inert gas to increase their power handling capacity and to eliminate the possibility of multipacting. The microwave signal must be conducted from the pressurized units to the vacuum environment of the spacecraft. The devices which allow for low loss passage of the microwave signals while maintaining the pressure difference are known as microwave windows.

A conventional coaxial microwave window includes a metallic conducting rod extending from the inside of the spacecraft to the outside environment, a ceramic insulating support which holds the central rod, and an annular ring which holds the ceramic support and allows the window to be fastened into the wall of the spacecraft. The microwave window is typically joined to a pressurized device in the interior of the spacecraft. The microwave window must therefore be fabricated so that there is a pressure-tight seal across the window, between the pressurized interior and the vacuum environment of the spacecraft.

To form a reliable, long-term, pressure-tight seal, the central rod is ordinarily brazed to the ceramic support, and the ceramic support is ordinarily brazed to the metallic annular ring supporting it. The brazing of metals to non-metals such as ceramics is difficult, because braze alloys typically do not wet and bond directly to ceramics. It has therefore been necessary to develop techniques to promote such wetting, including the application of metallic interlayers which wet the ceramic and also are wet by brazing alloys.

The brazing alloy and any interlayer alloys should be non-magnetic, since the presence of magnetic materials in the microwave window can lead to magnetically induced intermodulation. Such intermodulation signals are spurious microwave signals produced by the presence of the magnetic material, and become superimposed on the microwave signal being transmitted through the microwave window. Where such intermodulation signals are produced, it is typically necessary to filter out the intermodulation products from the transmitted microwave signal using filters such as notch filters on the main transmission lines. Such notch filters can typically add as much as 50 pounds to the weight of a spacecraft, and also reduce the total available effective radiated power of the microwave signal. Those intermodulation signals that fall in the band of the microwave transmission cannot be filtered and consequently degrade the transmitted signal.

The materials system used to form brazed joints in microwave windows must therefore allow the wetting of the braze metal to the ceramic support, and should also have a system coefficient of thermal expansion intermediate between that of the materials to be brazed. Unfortunately, the known materials which meet these requirements are magnetic, so that their use results in magnetic intermodulation products being imposed upon the transmitted microwave signal, and the consequent necessity of using filters which add weight to the spacecraft.

Wetting and adhesion have sometimes been promoted by roughening the metallized surfaces prior to bonding, to promote bonding. These roughened surfaces can lead to tunnelling-induced intermodulation signals, which are also undesirable. To date, there has been proposed no material system and approach for promoting the brazing of the metallic and nonmetallic components of microwave windows which does not produce the deleterious intermodulation effects.

The efficiency of microwave windows can also be reduced by multipacting, which is the secondary emission of electrons from surfaces exposed to radio frequency fields in a vacuum environment. Electrons emitted from the metallic center conductor in a vacuum environment can impact adjacent structures, resulting in the emission of secondary electrons. The secondary electrons can then impinge upon other structure resulting in yet further electron emission. The net effect of these emissions is to add additional spurious noise to the transmitted microwave signals. In some instances multipacting may be avoided by judicious selection of dimensions and dielectric materials in microwave systems. In others, electrical system requirements dictate the use of dimensions which fall well into the multipacting range for the frequencies involved.

There therefore exists a need for an improved microwave window, wherein intermodulation and multipacting effects are reduced. Preferably, such deleterious effects would be eliminated entirely, to avoid the need for heavy, expensive filters in the microwave transmission line. Such an approach must not interfere with the basic functioning of the microwave window, and must allow the transmission of the microwave signal while maintaining the integrity of the seal between the inside of the spacecraft and its external environment. Although this background of the microwave window has been directed primarily toward spacecraft applications, the same problems can be found in other microwave applications such as waveguide microwave windows, wherein a signal must be transmitted between two environments which are sealed apart from each other. The present invention fulfills this need for an improved microwave window, and further provides related advantages.

SUMMARY OF THE INVENTION

The present invention is embodied in a microwave window to be mounted in a wall between two media, and used to transmit a microwave signal from one side of the wall to the other, while maintaining the seal between the two media. The microwave window avoids magnetically induced intermodulation effects by eliminating magnetic materials from the window, while at the same time utilizing alloys to promote brazing of metallic parts to a ceramic support. When at least one of the media separated by the window is a vacuum, the microwave window can be geometrically configured to avoid multipacting. The resulting microwave window transmits a clean microwave signal, without any spurious noise introduced by the window itself, and may be fabricated by conventional technologies applied in a carefully controlled manner.

In accordance with the invention; a coaxial microwave window mounted in a wall between two media and used to transmit a microwave signal through the wall without intermodulation and multipacting, comprises a metallic center conductor; a metallic outer support; a ceramic support disposed between the outer support and the center conductor; and a pair of hermetic joints, one between the metallic center conductor and the ceramic support and the other between the metallic outer support and the ceramic support, each of the joints including a first layer bonded to the ceramic support, the first layer comprising a cermet portion and a cermet-nickel alloy portion, the cermet-nickel alloy portion being located in the part of the first layer remote from the ceramic support, the cermet-nickel alloy having a nickel concentration such that the cermet-nickel alloy is nonmagnetic, a second layer bonded to the first layer, the second layer comprising a copper portion and a copper-nickel alloy portion, the copper-nickel alloy portion being located in the part of the second layer adjacent the first layer, the copper-nickel alloy having a nickel concentration such that the copper-nickel alloy is nonmagnetic, and a third layer of brazing alloy between the second layer and the metallic piece. In a preferred embodiment, the center conductor is molybdenum, the outer conductor is a tungsten-copper alloy, and the ceramic support is beryllium oxide or aluminum oxide. The cermet portion is preferably a cermet of molybdenum, manganese, titanium and glass, and the brazing alloy is preferably an alloy of gold and copper. Such a microwave window is found to avoid intermodulation effects.

In another embodiment, a coaxial microwave window mounted in a wall between a vacuum and a second medium comprises a metallic center conductor; a metallic outer support; a ceramic support disposed between the outer support and the center conductor, the surface of the ceramic support contacting the vacuum comprising at least two noncoplanar segments; and a pair of hermetic joints, one between the center conductor and the ceramic support, and the other between the outer support and the ceramic support. Preferably, the center conductor is a cylindrical rod and the surface of the ceramic support contacting the vacuum includes a planar first segment whose plane is perpendicular to the rod's cylindrical axis, and a second segment whose surface is that of a frustrum of a cone whose conical axis coincides with the cylinder axis of the rod. If the second medium is also a vacuum, the surface of the ceramic support contacting the second medium also may comprise at least two noncoplanar segments. These microwave windows avoid multipacting effects on the transmitted microwave signal, when mated with a conforming, mirror-image conical surface of a dielectric piece so that all electircal fields between the center and any other conductors are intercepted.

More specifically, a microwave window mounted in a wall between a vacuum and a second medium, and used to transmit a microwave signal through the wall, comprises a molybdenum rod center conductor; a tungsten-copper alloy toroidal outer support; a ceramic toroidal support disposed between the outer support and the center conductor, the surface of the support contacting the vacuum comprising at least two noncoplanar segments; and a pair of hermetic joints, one between the center conductor and the ceramic support and the other between the outer support and the ceramic support, each of the joints including a first layer contacting the ceramic support, the first layer comprising a cermet portion and a cermet-nickel alloy portion, the cermet-nickel alloy portion being located in the part of the first layer remote from the ceramic support, the cermet-nickel alloy having a nickel concentration such that the cermet-nickel alloy is nonmagnetic, a second layer contacting the first layer, the second layer comprising a copper portion and a copper-nickel alloy portion, the copper-nickel alloy portion being located in the part of the second layer adjacent the first layer, the copper-nickel alloy having less than about 55 atomic percent nickel, and a third layer of a gold-copper brazing alloy.

It will now be appreciated that the present invention provides a significant advance in the field of microwave windows for hermetic and high power applications. The microwave window has excellent hermetic brazed joints, but avoids intermodulation effects by maintaining the nickel content below the level at which the nickel-containing alloy is magnetic. Multipacting is avoided on the vacuum side of the microwave window by forming that side as two noncoplanar surfaces to interrupt the electric field lines so that electrons cannot accelerate along those lines to cause secondary emission. Other features and advantages of the present invention will be apparent from the following more detailed description, taken in conjunction with the accompanying drawings, which illustrate, by way of example, the principles and some embodiments of the invention.

BRIEF DESCRIPTION OF THE DRAWINGS

FIG. 1 is a perspective view of a microwave window mounted in a wall;

FIG. 2 is an enlarged side sectional view of the microwave window of FIG. 1;

FIG. 3 is a greatly enlarged side sectional view of a detail of FIG. 2, taken generally along lines 3—3, illustrating the ceramic-metal bond;

FIG. 4 is a side sectional view of another embodiment of the microwave window for use when the window separates two vacuum environments, in a view similar to that of FIG. 2;

FIG. 5 is a side sectional view of another embodiment of the microwave window for use between two pressurized environments; and FIG. 6 is an end elevational view of another embodiment of the microwave window in the form of a waveguide.

DETAILED DESCRIPTION OF THE PREFERRED EMBODIMENT

In accordance with the invention and as illustrated in FIGS. 1 and 2, a microwave window 10 is provided in a wall 12 which separates a first environment 14 from a second environment 16. In the illustrated preferred embodiment, the first environment 14 is a vacuum, and the second environment 16 is pressurized, as with air or an inert gas. The window 10 must transmit microwaves from one side of the wall 12 to the other side, and must not allow a loss of pressure from the second environment 16 to the first environment 14.

The coaxial microwave window 10 includes a metallic center conductor 18, which is preferably a solid metallic rod of an electrical conductor such as molybdenum. An annular ceramic support 20 is disposed over the center conductor 18 to support and insulate the conductor 18. The inner diameter of the annulus of the ceramic support 20 is sufficiently greater than the outer diameter of the center conductor 18 to allow the formation of a first joint 22 between the center conductor 18 and the ceramic support 20, in the manner to be described.

An annular outer support 24 is disposed over the ceramic support 20. The outer support 24 is preferably formed of a conducting metal such as an alloy of 75 weight percent tungsten and 25 weight percent copper. The inner diameter of the outer support 24 is sufficiently greater than the outer diameter of the ceramic support 20 so that the outer support 24 may be placed over the ceramic support 20, and so that a second joint 26 may be formed between the outer support 24 and the ceramic support 20, in the manner to be described.

The outer support 24 is metallic, and may be joined to the wall 12 by any conventional joining technique, such as brazing, soldering, welding, or a mechanical connector. The present invention is not concerned with the manner of joining the outer support 24 to the wall 12.

In accordance with the invention, the ceramic support 20 is bonded to either the center support 18 or the outer conductor 24 by multiple layers including a layer of brazing alloy and two layers promoting the wetting and adhesion of the brazing alloy to the ceramic support 20. FIG. 3 illustrates the layers residing between the ceramic support 20 and the outer support 24, but substantially identical layers would be present between the ceramic support 20 and the center conductor 18.

Adjacent and bonded to the ceramic support 20 is a first layer 28, having a cermet portion 30 and a cermet-nickel alloy portion 32. The cermet portion 30 contacts and overlies the ceramic support 20, and the cermet-nickel alloy portion 32 is located in the portion of the first layer 28 remote from the ceramic support 20. For the preferred beryllium oxide and aluminum oxide materials of construction of the ceramic support 20, the preferred cermet material is a mixture containing about 80 weight percent molybdenum, about 17 weight percent manganese, about 0.25 weight percent titanium and about 2.75 weight percent glass. The cermet portion 30 hermetically bonds to the ceramic support 20, possibly because of the partial ceramic character of the cermet portion 30.

The cermet-nickel alloy portion 32 is an alloy formed between the material of the cermet portion 30 and nickel atoms. The nickel atoms preferably are provided by diffusing nickel into the cermet. Pure nickel is inherently a magnetic material, having a Curie temperature of about 368° C. (As used herein, the Curie temperature is the temperature of magnetic transformation below which a metal or alloy is magnetic.) Alloys of inherently non-magnetic materials with nickel typically have reduced Curie temperatures, so that increasing amounts of the non-magnetic material result in greatly reduced Curie temperatures of the alloys. For sufficiently high alloy contents of the non-magnetic material, there may be no temperature below which the alloy becomes magnetic.

The nickel content of the cermet-nickel alloy portion 32 must be sufficiently low that the alloy is not magnetic at the minimum intended temperature of use. Thus, if the minimum intended temperature of use is ambient temperature, typically the allowable nickel content is less than if the minimum intended temperature of use were 200° C., for example.

Deposited upon, contacting, bonded to, and overlying the first layer 28 is a second layer 34. The second layer 34 comprises a copper-nickel alloy portion 36 adjacent and contacting the first layer 28, and specifically contacting the cermet-nickel alloy portion 32. The copper portion 38 contacts and overlies the copper nickel alloy portion 36, and does not itself directly contact the first layer 28.

The composition of the copper-nickel alloy portion 36 is maintained at a nickel concentration sufficiently low that the alloy of the portion 36 is nonmagnetic, at the intended temperature of use of the microwave window 10. With increasing copper content of a copper-nickel alloy, the Curie temperature of the alloy decreases in the manner described previously. The scientific authorities differ on the exact Curie temperature of copper-nickel alloys, with some authorities indicating a continuously decreasing Curie temperature with increasing copper, and other authorities indicating a solid state miscibility gap in the copper-nickel system at lower temperatures. In the latter case, the miscibility gap is suggested to result in a constant Curie temperature across the width of the gap. The exact nature of the Curie temperature of the copper-nickel alloy is thought to be dependent upon the processing history of the copper-nickel alloy. Since the maximum nickel content is difficult to predict theoretically, it is preferred that the microwave window 10 be prepared in the manner to be described and then tested to confirm that the microwave window does not have any magnetic characteristics producing intermodulation effects. With increasing use, the nickel content of the copper-nickel alloy portion 36 would decrease due to interdiffusion effects, with the result that the alloy content of the copper-nickel alloy portion 36 would increase, producing a lower Curie temperature of the alloy. Thus, the continuing use of the microwave window 10 in its operating environment would not be expected to result in a spontaneous magnetic transformation which would impair the use of the microwave window 10.

It is believed that the maximum nickel content of the copper-nickel alloy portion 36 is from about 55 to about 70 atom percent nickel for a microwave window 10 whose minimum intended temperature of use is ambient temperature. To avoid the possibility of unintended processing variations which might result in a magnetic alloy, it is therefore preferred that the nickel content of the copper-nickel alloy portion 36 be less than from about 55 to about 70 atom percent nickel, and most preferably less than about 55 atom percent nickel.

As is now apparent, the element nickel is chosen to be common between the cermet-nickel alloy portion 32 and the copper-nickel alloy portion 36. The commonality of nickel in these two portions promotes the bonding between the first layer 28 and the second layer 34, while at the same time no un-alloyed or free nickel is present. Any such free nickel is unacceptable, as it would produce a magnetic signal resulting in undesirable intermodulation effects. The alloys in the alloy portions 32 and 36 are nonmagnetic through control of alloy composition, and there is no nickel metal or other magnetic material present in the microwave window 10.

A third layer 40 is located between the second layer 34 and the outer support 24. The third layer 40 is of a brazing alloy such as a gold-copper alloy, and preferably an alloy of 50 weight percent gold, 50 weight percent copper. The brazing alloy in the third layer 40 readily wets and bonds to the copper portion 38 and to the outer support 24. If the first layer 28 and to the outer layer 34 were not present, it would not be possible to bond the brazing alloy of the third layer 40 directly to the ceramic support 20, since such brazing alloys do not wet and bond to typical ceramic materials. Thus, the approach of using a three layered bond between the ceramic support 20 and the outer support 24 allows the fabrication of a nonmagnetic hermetic joint 26. As indicated previously, the joint 22 between the center conductor 18 and the ceramic support 20 is formed in a similar manner, by providing a first layer 28, a second layer 34, and a third layer 40 between the ceramic support 20 and the center conductor 18.

Another significant problem in the preparation of microwave windows is the secondary emission of electrons from surfaces exposed to radio frequency fields in a vacuum environment, a phenomenon generally termed multipacting. In the context of prior art microwave windows, multipacting arises when electrons are emitted from the center conductor and accelerated along electric field lines to impact neighboring components. If the power levels are high and the dimensions of the components are sufficiently large, the emitted electrons are accelerated to sufficiently high energies that their impact on adjacent components causes a production of secondary electrons, which may in turn then result in further avalanches of secondary emission electrons. The problem of multipacting typically arises in a vacuum environment, since there is no medium which reduces the energy of emitted electrons, as by collisions with gas atoms. Where the center conductor is in a gaseous or pressurized environment, generally the presence of the gaseous medium prevents multipacting. However, in a pressurized environment, unless the pressure is high enough, a different problem, corona formation, may appear.

In accordance with the present invention, on the side of the microwave window 10 exposed to a vacuum, the surface of the ceramic support 20 is formed of at least two noncoplanar segments. Since the segments are noncoplanar, electrons cannot be accelerated in a straight line through the gap between the ceramic support 20 and adjacent insulation. The emitted electrons cannot be accelerated for long distances in a straight line, and their final energy is reduced so that they cannot impact neighboring structure with sufficient energy to cause secondary emission. Thus, multipacting in a vacuum environment is avoided.

More specifically, in the illustration of FIG. 2 the first enviroment 14 is a vacuum, and the second environment 16 is a pressurized medium such as air at one atmosphere pressure. The surface of the ceramic support 20 facing the pressurized second environment 16 can be a planar surface, since the air in the second environment 16 inhibits the acceleration of electrons emitted from the center conductor 18. Multipacting does not occur in this environment, but corona formation may be found.

In the absence of preventative measures, multipacting would occur on the vacuum side, in the first environment 14. Multipacting is prevented by forming the surface of the ceramic support 20 as two noncoplanar segments. In the preferred embodiment, the noncoplanar segments are furnished as a planar first segment 42, whose plane is perpendicular to the cylindrical axis of the center conductor 18, and a conical second segment 44 whose surface is that of a frustum of a cone, whose conical axis coincides with the cylindrical axis of the center conductor 18. The noncoplanar segments could be formed in many other ways, as long as there is not a straight line path for electrons to be accelerated outwardly from the center conductor 18 in a gap 46 between the ceramic support 20 and an insulator 48. The insulator 48 is preferably a polytetrafluoroethylene (Teflon) sleeve which fits over the center conductor 18 and has an end surface which conforms to that of the ceramic support 20. In the prior practice wherein the surface of the ceramic support 20 facing a vacuum was a fully planar surface, electrons could find their way outwardly from the center conductor 18 in the gap between the ceramic support and the insulator. With the approach of the present invention, the gap 46 is noncoplanar, so that electrons cannot be accelerated outwardly from the center conductor 18 in a straight line without inpinging upon the insulator 48, which slows the emitted electrons and reduces their energy, thereby avoiding production of secondary electrons or multipacting.

The ceramic support 20 has cylindrical symmetry, so that the second segment 44 is conveniently prepared as the surface of a frustum of a cone, wherein the conical axis coincides with the rod axis of the center conductor 18. Although many other shapes can be envisioned, the described approach is particularly convenient since ceramics such as those used in the ceramic support 20 and insulator materials such as used in the insulator 48, are not readily fabricated in all mutually conforming surface arrangements so as to minimize the gap 46 between the noncoplanar segments. The preferred arrangement illustrated in FIG. 2 can be readily fabricated, since the ceramic support 20 can be cast or ground to shape, and the insulator 48 is readily machined to the end shape illustrated.

If the microwave window is between two vacuum media, which must be separated by the wall 12 for reasons other than a pressure seal, a microwave window 50 may be used, wherein both sides of the ceramic support 20 are formed of noncoplanar segments, thereby avoiding multipacting on both sides of the center conductor 18. The principles in structure described previously in relation to this aspect of FIG. 2 also apply to the two-sided configuration illustrated in FIG. 4.

The microwave window 10 may be fabricated by furnishing a metallic center conductor 18, a metallic outer support 24, and a ceramic support 20 dimensioned to fit together in the manner illustrated in FIG. 2. That is, the center conductor is dimensioned to fit within the center cylindrical gap of the ceramic support 20. In a typical 50 ohm coaxial microwave window, the inner diameter of the cylindrical bore along the center of the ceramic support 20 has a diameter of about 0.042 to about 0.048 inches, and the clearance between the outer diameter of the center conductor 18 and the inner diameter of the ceramic support 20 is selected to be from about 0.0036 to about 0.0041 inches. The inner diameter of the annular outer support 24 is selected to be about 0.268 inches, and the outer diameter of the ceramic support 20 is selected to be about 0.265 inches, for a total clearance of about 0.003 inches. The center conductor 18 fits within the ceramic support 20 along a first bonding surface 52, and the ceramic support 20 fits within the outer support 24 along a second bonding surface 54. Before the three parts 18, 20 and 24 are assembled together, the material along the first bonding surface 52 and the second bonding surface 54 of the ceramic support 20 is specially prepared to form the first layer 28 and the second layer 34 on the surface of the ceramic support 20.

The first layer 28 and the second layer 34 are prepared on the surface of the ceramic support 20 by the following sequence of process steps. A cermet layer 28 is formed at each bonding surface 52 and 54 of the ceramic support 20 by metallizing the surface with an appropriate cermet composition. Preferably, a mixture of about 80 weight percent molybdenum, about 17 weight percent manganese, about 0.25 weight percent titanium, and about 2.75 weight percent glass is deposited onto the surfaces 52 and 54 of the ceramic support 20 and furnace fired in a wet hydrogen environment. A layer of nickel about 0.000050 inches thick is then electrodeposited over the cermet layer. A second layer of copper about 0.000100 inch thick is electrodeposited over the nickel layer. At this point, the piece comprises the ceramic support 20, a layer of cermet, a layer of undiffused elemental nickel overlying the cermet, and a layer of copper overlying the nickel. It is recognized that, if no further treatments were done, the layer of elemental nickel would be a source of magnetic signal, resulting in intermodulation of the microwave signal. To avoid this effect, the piece is placed into a hydrogen furnace operating at about 550° C. for a period of about 1½ hours, so that the layer of undiffused elemental nickel diffuses into its surrounding environment, with some of the nickel diffusing into the copper layer to form the copper-nickel alloy portion 36, and some of the nickel diffusing into the cermet to form the cermet-nickel alloy portion 32. The processing times are selected so that the resulting cermet-nickel alloy portion 32 and the copper-nickel alloy portion 36 have compositions that are nonmagnetic in the finished window. It is recognized that this first diffusing treatment may not result in complete interdiffusion and disappearance of the elemental nickel, but the combination of this first diffusing treatment and the heating required in the subsequent brazing step does result in complete disappearance of the nickel. Thus, the nickel interlayer is used to assist in the bonding of the first layer 28 to the second layer 34, but the nickel interlayer is diffused away into the alloy portions 32 and 36 so that no magnetic nickel layer remains to create intermodulation effects. At this point, the ceramic support 20 is ready for brazing, and is termed a "prepared support."

The center conductor 18 is placed within the cylindrical bore of the ceramic support 20, and then the ceramic support 20 is placed within the outer support 24, so that truly aligned mating surfaces are formed along the bonding surfaces 52 and 54. This assembly is held in alignment through the use of matching tooling, and a drop of brazing alloy is placed at the ends of the bonding surfaces 52 and 54. Preferably, the brazing alloy is of composition 50 weight percent gold - 50 weight percent copper. The assembly is placed into a vacuum brazing furnace operating at about 1000° C. for a time of about 1½ hours, so that the brazing alloy infiltrates along the bonding surfaces 52 and 54 and to complete the interdiffusion of the nickel, copper and cermet. The furnace is turned off, and the assembly is cooled so that the brazing alloy solidifies to form the solidified third layer 40, thereby completing the formation of the joints 22 and 26.

The metallurgical bonding technique can be used in other types of microwave windows, as illustrated in FIGS. 5 and 6, where intermodulation is otherwise expected. In a microwave window 60 for use between two pressurized environments, the microwave signal is carried on a center conductor 62. An annular ceramic support 64 is disposed over the center conductor 62, and an annular outer support 66 is disposed over the ceramic support 64. The previously described bonding technique is used to bond the ceramic support 64 to the center conductor 62, and to bond the ceramic support 64 to the outer support 66, without the presence of a magnetic alloy.

Similarly, the bonding technique is used in fabrication of a microwave waveguide window 68, as illustrated in FIG. 6, to avoid intermodulation effects. A waveguide 70 is supported by an overlying ceramic support 72, which in turn is supported by an overlying outer support 74. The previously described bonding technique is used to bond the ceramic support 72 to the waveguide 70, and to bond the ceramic support 72 to the outer support 74, without the presence of any magnetic alloy.

As is now seen, the microwave window of the invention provides a structure which avoids the use of magnetic materials, thereby minimizing interference with the transmitted microwave signal arising from intermodulation. Where the microwave window is to be used in conjunction with a vacuum environment, the surface of the ceramic support facing the vacuum can be configured from at least two noncoplanar segments, thereby avoiding a straight line path for the acceleration of emitted electrons from the center conductor, with the result that adverse multipacting effects on the transmitted microwave signal are also avoided. This microwave window avoids introduction of extraneous noise to the transmitted microwave signals, thereby eliminating the need to use the heavy filters required with other microwave window designs. Although a particular embodiment of the invention has been described in detail for purposes of illustration, various modifications may be made without departing from the spirit and scope of the invention. Accordingly, the invention is not to be limited except as by the appended claims.

What is claimed is:

1. A coaxial microwave window mounted in a wall between two media and used to transmit a microwave signal through the wall without intermodulation and multipacting, comprising:

a metallic center conductor;

a metallic outer support;

a ceramic support disposed between said outer support and said center conductor; and a pair of hermetic joints, one between said metallic center conductor and said ceramic support and the other between said metallic outer support and said ceramic support, each of said joints including a first layer bonded to said ceramic support, said first layer comprising a cermet portion and a cermet-nickel alloy portion, said cermet-nickel alloy portion being located in the part of said first layer remote from said ceramic support, said cermet-nickel alloy having a nickel concentration such that said cermet-nickel alloy is nonmagnetic.

a second layer bonded to said first layer, said second layer comprising a copper portion and a copper-nickel alloy portion, said copper-nickel alloy portion being located in the part of said second layer adjacent said first layer, said copper-nickel alloy having a nickel concentration such that said copper-nickel alloy is nonmagnetic, and a third layer of brazing alloy bonded between said second layer and said metallic outer support.

2. The microwave window of claim 1, wherein said center conductor is molybdenum.

3. The microwave window of claim 1, wherein said metallic meter support is a tungsten-copper alloy.

4. The microwave window of claim 1, wherein said support is selected from the group of ceramics consisting of beryllium oxide and aluminum oxide.

5. The microwave window of claim 1, wherein said cermet portion consists essentially of molybdenum, manganese, titanium and glass.

6. The microwave window of claim 1, wherein said brazing alloy consists essentially of gold and copper.

7. The microwave window of claim 1, wherein at least one of the media is a vacuum, and the surface of said support contacting the vacuum comprises at least two noncoplanar segments.

8. A microwave window mounted in a wall between a vacuum and a second medium, and used to transmit a microwave signal through the wall, comprising:

a molybdenum rod center conductor;

a tungsten-copper alloy toroidal outer support;

a ceramic toroidal support disposed between said outer support and said center conductor, the surface of said support contacting the vacuum comprising at least two noncoplanar segments; and a pair of hermetic joints, one between said center conductor and said ceramic support and the other between said outer support and said ceramic support, each of said joints including a first layer contacting said ceramic support, said first layer comprising a cermet portion and a cermet-nickel alloy portion, said cermet-nickel alloy portion being located in the part of said first layer remote from said ceramic support, said cermet-nickel alloy having a nickel concentration such that said cermet-nickel alloy is nonmagnetic, a second layer contacting said first layer, said second layer comprising a copper portion and a copper-nickel alloy portion, said copper-nickel alloy portion being located in the part of said second layer adjacent said first layer, said copper-nickel alloy having less than about 55 atomic percent nickel, and a third layer of a gold-copper brazing alloy.

9. The microwave window of claim 8, wherein said support is selected from the group of ceramics consisting of beryllium oxide and aluminum oxide.

10. The microwave window of claim 8, wherein said cermet portion consists essentially of molybdenum, manganese, titanium and glass.

11. The microwave window of claim 8, wherein said surface of said ceramic support contacting the vacuum comprises a planar first segment whose plane is perpendicular to the rod cylindrical axis, and a second segment whose surface is that of a frustum of a cone whose conical axis coincides with the rod center conductor axis.

12. The microwave window of claim 8, wherein the second medium is a vacuum, and the surface of said ceramic support contacting the second medium comprises at least two noncoplanar segments.

* * * * *